US009530532B2

(12) United States Patent
Spalding et al.

(10) Patent No.: US 9,530,532 B2
(45) Date of Patent: Dec. 27, 2016

(54) HYBRID CONDUCTOR WITH CIRCUMFERENTIAL CONDUCTING LAYERS

(71) Applicant: ABB Technology AG, Zurich (CH)

(72) Inventors: Matthew Spalding, Cornelius, NC (US); Sherif Kamel, Cary, NC (US); David Lindsay, Charlotte, NC (US)

(73) Assignee: ABB Schweiz AG, Braden (CH)

( * ) Notice: Subject to any disclaimer, the term of this patent is extended or adjusted under 35 U.S.C. 154(b) by 0 days.

(21) Appl. No.: 14/564,301

(22) Filed: Dec. 9, 2014

(65) Prior Publication Data

US 2016/0055943 A1 Feb. 25, 2016

Related U.S. Application Data

(63) Continuation-in-part of application No. 14/466,498, filed on Aug. 22, 2014.

(51) Int. Cl.

| | |
|---|---|
| ***H01B 7/30*** | (2006.01) |
| ***H01B 1/02*** | (2006.01) |
| ***H01B 9/00*** | (2006.01) |

(52) U.S. Cl.

CPC ..... *H01B 1/026* (2013.01); *H01B 1/023* (2013.01); *H01B 9/006* (2013.01)

(58) Field of Classification Search

CPC ..... H01B 7/30; H01B 1/023; H01B 1/026
USPC ..... 174/102 R, 113 R
See application file for complete search history.

(56) References Cited

U.S. PATENT DOCUMENTS

| | | | | |
|---|---|---|---|---|
| 4,549,042 | A | 10/1985 | Akiba | |
| 4,783,576 | A | 11/1988 | Silver et al. | |
| 5,223,349 | A | 6/1993 | Kudo et al. | |
| 6,376,775 | B1 * | 4/2002 | Leijon | H01F 3/10 174/128.1 |
| 7,572,980 | B2 | 8/2009 | Elie et al. | |
| 8,245,396 | B2 | 8/2012 | Kondo et al. | |
| 2012/0163758 | A1 * | 6/2012 | McCullough | H01B 7/14 385/101 |
| 2012/0234577 | A1 | 9/2012 | Kim | |

FOREIGN PATENT DOCUMENTS

| | | |
|---|---|---|
| EP | 224457 | 1/2010 |
| GB | 2525546 | 10/2015 |
| WO | WO2014127661 | 8/2014 |

* cited by examiner

*Primary Examiner* — Timothy Thompson
*Assistant Examiner* — Amol Patel
(74) *Attorney, Agent, or Firm* — Taft Stettinius & Hollister LLP

(57) ABSTRACT

A conducting medium or high voltage cable can include at least one conductor surrounded by an insulating layer. One or more layers of conducting wires can surround the insulating layers, and the layers of conducting wires themselves can be separated by insulating layers. The centrally disposed conductor and surrounding circumferential conducting layers can include copper, aluminum, or a combination of both. The central conductor can range between about 1000 kcmil to about 4000 kcmil cross-sectional area, and the surrounding layers of conducting wires can be at least about 250 kcmil.

19 Claims, 8 Drawing Sheets

HYBRID CONDUCTOR WITH CIRCUMFERENTIAL CONDUCTING LAYERS

CROSS-REFERENCE TO RELATED APPLICATIONS

The present application is a continuation-in-part of U.S. patent application Ser. No. 14/466,498, filed on Aug. 22, 2014.

FIELD OF INVENTION

The present disclosure concerns cables for conducting alternating electrical current with hybrid conductors, in particular medium and high voltage conductors including electrically conductive wires.

BACKGROUND

Copper conductors have higher ampere capacity ("ampacity") than aluminum conductors and can be considered preferable over aluminum for a variety of applications, in particular in applications where voltage and conductor size demands are in ranges where the ampacity difference between copper and aluminum is most pronounced. However, as one or both of current and cross-sectional area of a copper conductor increase, "skin effect" causes a greater proportion of current to travel through the conductor at the periphery of the conductor and a lesser proportion of current to travel through the center of the conductor. Further, due to the skin effect, the marginal contribution of additional copper to the ampacity of the conductor decreases as it gets larger, resulting in greater inefficiencies in electrical power transmission through such cables. In addition, the monetary cost of copper is greater than other potential conductors such as aluminum, and the weight of copper per unit volume is also greater than other potential conductors, such as aluminum, which results in greater costs inherent in transporting and installing such conductors. Thus, a conductor that mitigates against such inefficiencies and costs would be beneficial.

SUMMARY

An alternating current ("AC") medium or high voltage cable can include at least one conductor surrounded by an insulating layer. One or more layers of conducting wires can surround the insulating layers, and the layers of conducting wires themselves can be separated by insulating layers. The centrally disposed conductor and surrounding circumferential conducting layers can include copper, aluminum, or a combination of both. The central conductor can range between about 1000 kcmil to about 4000 kcmil cross-sectional area, and the surrounding layers of conducting wires can be at least 250 kcmil.

BRIEF DESCRIPTION OF THE DRAWINGS

In the accompanying drawings, structures and methods are illustrated that, together with the detailed description provided below, describe aspects of an electrically conducting cable having circumferential layers of conducting wires. It will be noted that a single component may be implemented as multiple components or that multiple components may be implemented as a single component. The figures are not drawn to scale and the proportions of certain parts have been exaggerated for convenience of illustration. Further, in the accompanying drawings and description that follow, like parts are indicated throughout the drawings and written description with the same reference numerals, respectively.

DETAILED DESCRIPTION

Figure 1:
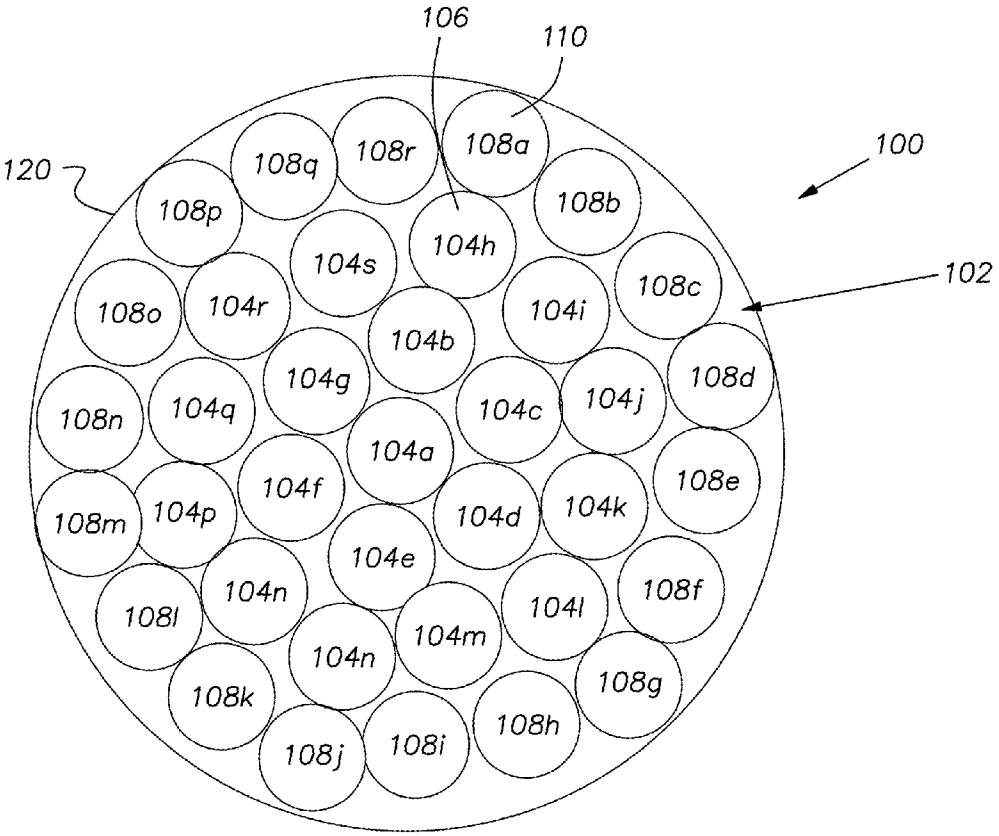
FIG. 1 illustrates a cross-sectional view of conducting cable 100.

With reference to FIG. 1, a conducting cable 100 includes a conducting wire bundle 102 having a plurality of wires **104*a*-104*s* of a first conductive material. As used herein, the term "wire" denotes a solid or woven, non-hollowed wire of a particular conductive material, such as copper, aluminum, or other conductive metal or alloy. The plurality of wires 104*a*-104*s* together form a core 106 surrounded by a plurality of wires 108*a*-108*r* including a second conductive material. The plurality of wires 108*a*-108*r* together form an outer layer 110 surrounding the core. According to one aspect of the present teachings, the first conductive material and second conductive material are chemically distinct materials. According to another aspect of the present teachings, the first conductive material is aluminum, and the second conductive material is copper. According to a further aspect of the present teachings, the cable 100 is a medium (i.e. between about 2 kV to about 70 kV) or high voltage AC cable (i.e. over about 100 kV), operable to be able to conduct AC current in the kilovolt range, including for example at voltages of about 20 kV or greater under normal operation. The total cross-sectional area of the wires 104*a*-104*s* and 108*a*-108*r* can be at least about 2500 kcmils. According to another aspect of the present teachings, the total cross-sectional area of the wires 104*a*-104*s* and 108*a*-108*r* can be at least about 3000 kcmils. According to yet another aspect of the present teachings, the total cross-sectional area of the wires 104*a*-104*s* and 108*a*-108*r*** can be at least about 3500 kcmils.

According to yet another aspect of the present teachings, a subset of the conductive wires in the conductor include a particular conducting metal having a particular characteristic skin effect depth, which will also be referred to herein as "characteristic skin depth." Characteristic skin depth values of metals can be determined by referring to chemical or electrical reference literature, or by direct measurement of, for example, the depth of the wire through which a certain fraction of the current is concentrated. The remaining conducting wires not in the aforementioned subset, i.e. the complementary set of wires, can include a different conducting metal having a different characteristic skin depth. According to yet another aspect of the present teachings, at least one of the wires used in the subset of wires or the complementary set of wires has an outer barrier including a nonconductive oxide of the material used. For example, aluminum wires can include an outer barrier of aluminum oxide and be combined with copper wires. In another example, aluminum wires can be combined with chemically distinct aluminum alloy wires with both having a nonconductive outer barrier of aluminum oxide.

The conducting cable 100 includes an outer sheath 120 that surrounds bundle 102. According to one aspect of the present teachings, the outer sheath 120 can be made of a nonconductive material, including but not limited to polyethylene, Mylar or other nonconductive materials and combinations thereof. According to another aspect of the present teachings, the outer sheath 120 can include a waterproof material such that the bundle 102 including the first and second conductive materials, respectively, is protected from external sources of moisture. According to yet another aspect of the present teachings, the sheath 120 can be removed, or material in addition to or different from the sheath 120 can surround the wire bundle 102 to perform various functions, such materials including metals and nonmetal, or naturally occurring and synthetic materials.

Figure 2:
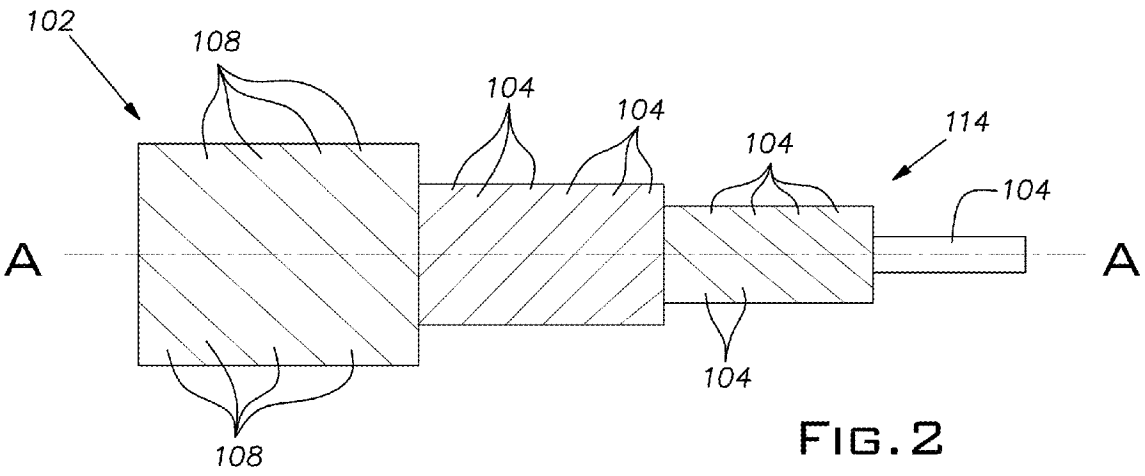
FIG. 2 illustrates a partial side-sectional view of conducting cable 100.

With reference to FIG. 2, the wires 108 and wires 104 are shown twisted about the longitudinal axis A of the wire bundle 102 in opposing clockwise and counterclockwise directions relative to adjacent layers. According to another aspect of the present teachings, the wires 104, 108 can be wrapped or woven in different configurations.

Figure 3:
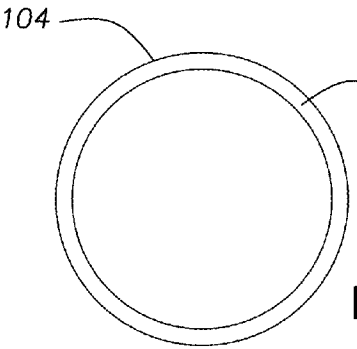
FIG. 3 illustrates a cross-sectional view of wire 108.

With reference to FIG. 3, one of the plurality of wires 104 includes the first conductive material and an insulating barrier 122. According to one aspect of the present teachings, the insulating barrier 122 is aluminum oxide, which is an electrical insulator. Such an insulating barrier 122 can be generated, for example, by exposure of aluminum wire 104 to oxygen, which results in the aluminum on the surface of wire 104 undergoing oxidation to form an aluminum oxide outer insulating barrier 122. As used herein, the term "uncoated" denotes the lack of any insulating material applied or otherwise found on the outer surface of the wires such as wires 104, 108 referred to in FIGS. 1 and 2 herein, with the exception of any one or more of the various possible oxide forms of the underlying material of the wires. As such, aluminum wires that are "uncoated" will not include any enamel coating or otherwise have any coating of insulating material or sheath placed on the outer surface of the wires. However, such an "uncoated" wire can include an outer barrier of aluminum oxide, such as a barrier of aluminum oxide having chemical formula $Al_2O_3$ on the outer surface of the aluminum wire.

Figure 4:
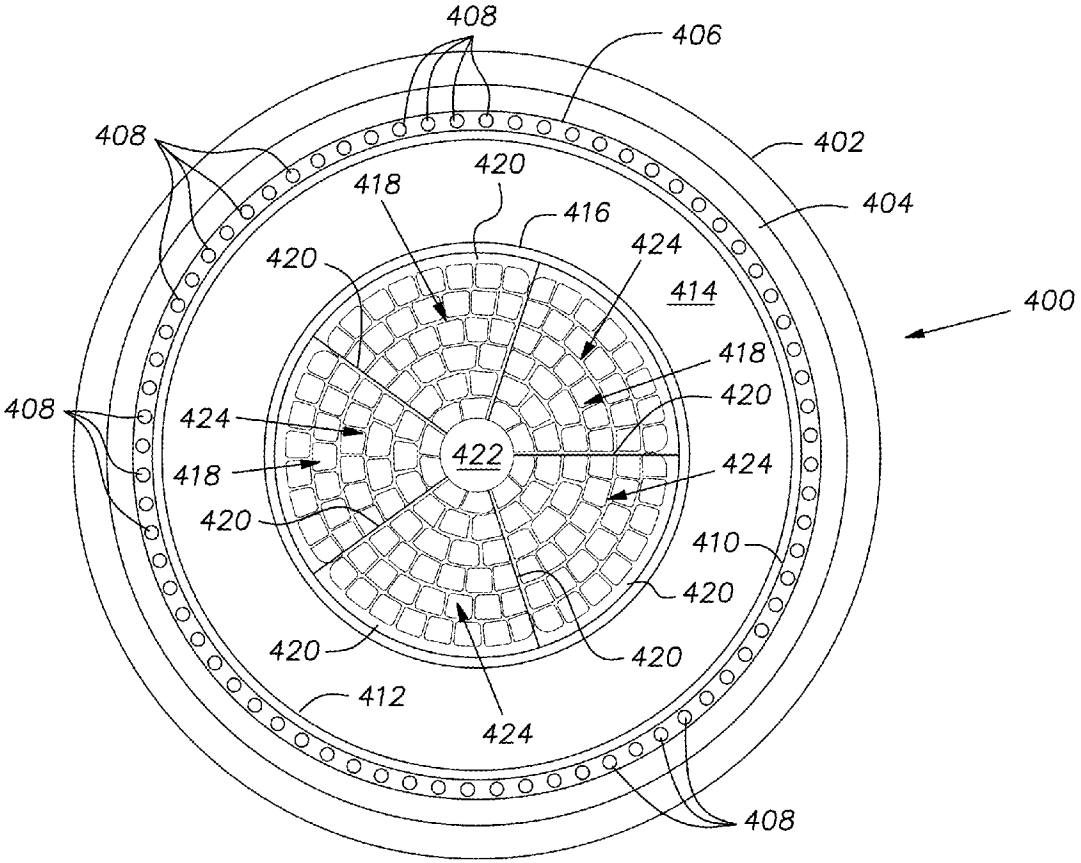
FIG. 4 illustrates a cross-sectional view of Milliken cable 400.

With reference to FIG. 4, a cross-sectional view of a cable 400 configured to conduct electrical current. The cable 400 can have several layers of material surrounding the wires disposed closer to the cross-sectional center of the cable 400. An outermost jacket 402 of polypropylene, or high or medium density polyethylene, can protect the cable from environmental contaminants that can damage the underlying layers and in particular the conducting central portion. Underneath the jacket 402, a lead sheath 404 can provide further protection from contaminants such as moisture to the layers beneath the lead sheath 404. According to one aspect of the present teachings, a layer 406 of steel tape and a layer 408 of reinforcing steel wires can be disposed underneath the lead sheath 404, and can provide reinforcing strength and shielding from electromagnetic fields. Two additional layers 410, 412 of steel tape can surround a conductive layer 414 of carbon and metallized paper. The conductive layer 414 can surround a layer 416 of semiconducting carbon paper, which in turn can surround five wedge-shaped conductors 418. Each of the five wedge-shaped conductors 418 can be surrounded by a layer 420 of semiconducting carbon paper or tape. The illustrated semiconducting layers 420 separate the segmented conductors 418 from one another over the length of the cable 400. An aluminum support member 422 can be disposed at the center of the cable 400. According to other aspects of the present teachings, the aluminum support member 422 can be substituted with a filler, such as viscous oil or plastic, or remain hollow. Cables according to the present teachings can have a variety of layers having various functions surrounding the conducting wires of the cables. The composition and arrangement of such layers can depend on the environment in which the cable will operate, whether marine, underground or other location.

The five segmented conductors 418 illustrated FIG. 4 each include a wire bundle 424 having thirty conductive wires. According to one aspect of the present teachings, a subset of the conductive wires in the conductor 418 include a conducting metal having a particular characteristic skin depth surround the remaining wires of the conductor 418, which are made of a chemically distinct metal having a thicker characteristic skin depth value. For example, for a cylindrical wire conducting alternating current at 60 Hertz, the skin depth of copper and aluminum can differ from one another by about 25 percent. Under such example conditions, an aluminum wire can exhibit a characteristic skin depth of 10.9 mm, while such a copper wire can exhibit a characteristic skin depth of 8.5 mm. According to one aspect of the present teachings, the total cross-sectional area of the wires conducting current is at least about 2500 kcmil or greater. According to another aspect of the present teachings, the total cross-sectional area of the wires conducting current is at least about 3000 kcmil or greater. According to yet another aspect of the present teachings, the total cross-sectional area of the wires conducting current is at least about 3500 kcmil or greater.

Figure 5:
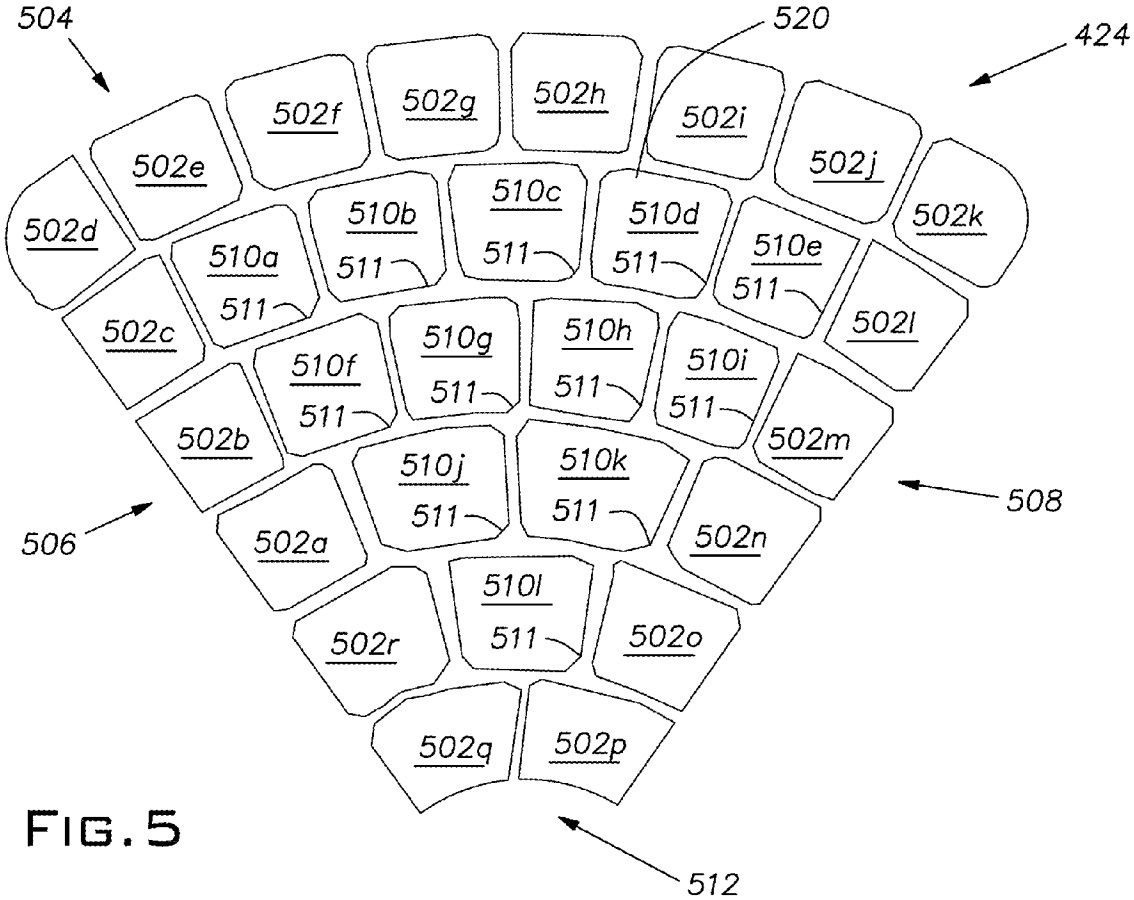
FIG. 5 illustrates a cross-sectional view of hybrid conductor 424.

With reference to FIG. 5, one of the wire bundles 424 of conductors 418 shown in FIG. 4 includes eighteen wires 502*a*-502*r* of a conductive metal arranged along the wide end 504, the first and second sides 506, 508 and narrow end 512 of the wedge-shaped conductor 418. The eighteen wires 502 can surround twelve wires 510*a*-510*l* of another conductive metal that form a conductor core 520. According to one aspect of the present teachings, each of the eighteen wires 502 includes copper, and each the twelve wires 510 at the core 520 includes aluminum. The wires 502, 510 can have trapezoidal, rectangular, circular, polygonal or other shapes.

With reference to FIGS. 4 and 5, five of the conductors 418 are arranged about the support member 422 such that the first side 506 of one of the wires bundles 424 is adjacent the second side 508 of an adjacent wire bundle 424, separated only by the semiconducting insulating layers 420 surrounding the wire bundles 424. Each of the sides 506, 508 of the wire bundles 424 extends from the narrow end 512, which is adjacent to the support member 422, to the wide end 504, which is distal to the support member 422 relative to the bundle 424.

According to other aspects of the present teachings, more or less wire bundles and conductors can be implemented. For example, as few as four wire bundles and up to as many as six wedge-shaped bundles can be implemented according to the present teachings. In addition, a cable 400 can implement multiple wedge-shaped conductors each having a distinct arrangement of wires 502 of the first conductive material and wires 510 of the second conductive material.

For example, bundles can have more than one layer of copper wires 502 surrounding a core 520 including aluminum wires. In yet another aspect, two or more bundles can have a common arrangement of wires 502 of the first conductive material and wires 510 of the second conductive material. According to one aspect of the present teachings, the ratio of the cross-sectional area of aluminum wires to copper wires in the bundles 424 can differ from bundle 424 to bundle 424.

Figure 6:
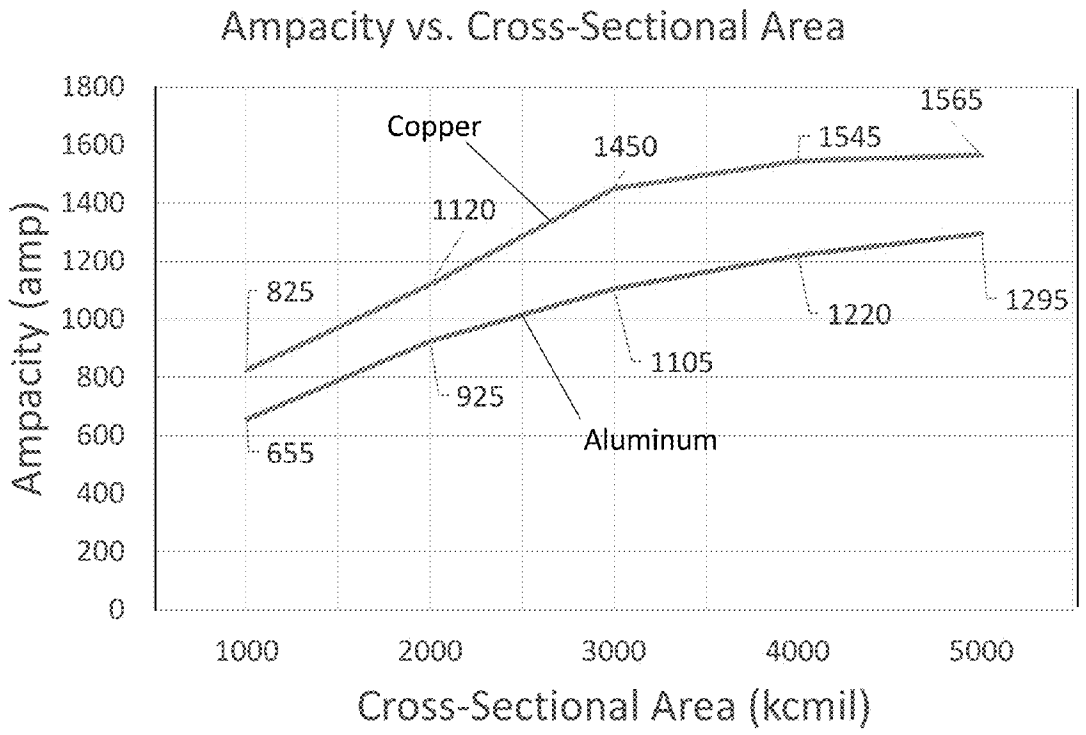
FIG. 6 illustrates a graph of modeled ampacity versus cross-sectional area for copper and aluminum conductors.
Figure 7:
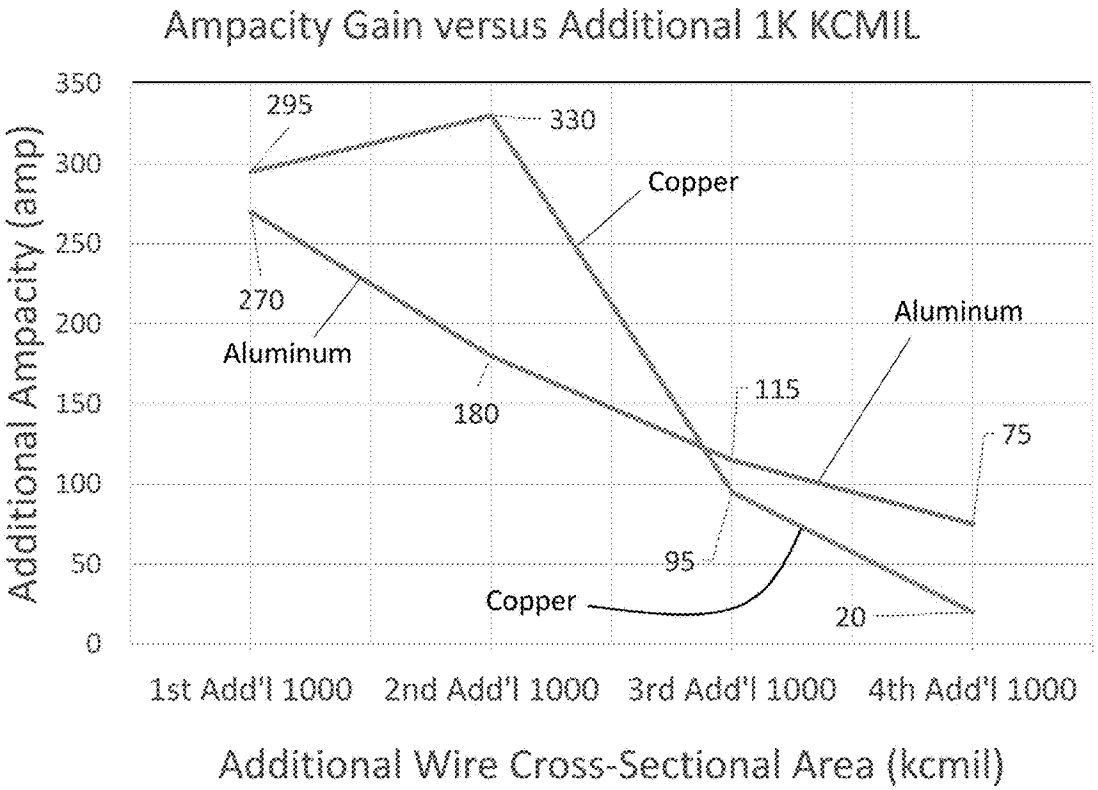
FIG. 7 illustrates a graph of modeled ampacity gain versus incremental additional cross-sectional area for copper and aluminum conductors.

With reference to FIG. 6, simulation data of the ampacity of a 100 percent copper conductor is compared to that of a 100 percent aluminum conductor, each being in a cable arranged in a trefoil configuration with two additional identical cables. The simulated conductors have the total nominal cross-sectional area indicated in kcmil on the independent axis, and the corresponding ampacity in the dependent axis for 1000 kcmil increments starting at 1000 kcmil through 5000 kcmil. The ampacity of copper is higher than that for aluminum for total cross-sectional areas ranging from 1000 kcmil through 5000 kcmil. As shown in FIG. 7, the added ampacity, shown on the dependent axis, for each incremental addition of 1000 kcmil of the particular conductor material initially increases in the case of copper between the first and second additional 1000 kcmil of copper wire added. For copper, the first 1000 kcmil added, corresponding to a conductor having a 2000 kcmil cross-section, results in an additional 295 amperes. The second 1000 kcmil of copper wire added corresponds to an even greater increase of 330 amperes. The next increment of additional copper conductor, however, begins to provide less additional ampacity. The third 1000 kcmil of copper adds 95 amperes, while the fourth 1000 kcmil adds an additional 20 amperes.

With continued reference to FIG. 7, the relative behavior of aluminum conductors increasing in cross-sectional size differs from that of copper conductors. The first and second additional 1000 kcmil of aluminum provide lower additional amounts of ampacity than the corresponding additions of copper. However, the third and fourth additional 1000 kcmil of aluminum provide more additional ampacity than the corresponding additions of copper. This due in significant part to the more pronounced skin effect characteristics of copper as compared to aluminum, which offsets the higher conductivity of copper at greater cross-sectional thicknesses. As such, addition of aluminum can provide more additional ampacity than a comparable addition of copper for cable having sufficient cross-sectional area. As can be seen from FIGS. 6 and 7, further addition of copper to a conductor with around 2500 to 4000 kcmil of copper wire can be less beneficial than addition of aluminum wire to that conductor, or alternatively segregating such a conductor, such as with semiconducting tape, from any additional copper or aluminum wires added in order to provide the desired additional ampacity. Moreover, increase of ampacity through the addition of aluminum rather than copper can be desirable, even for cable thicknesses where copper would provide more additional ampacity per additional kcmil of copper than the same amount of additional aluminum. Such an increase in ampacity with addition of copper can be desirable due to constraints such as cost or a desired lower weight per unit length of cable.

Figure 8:
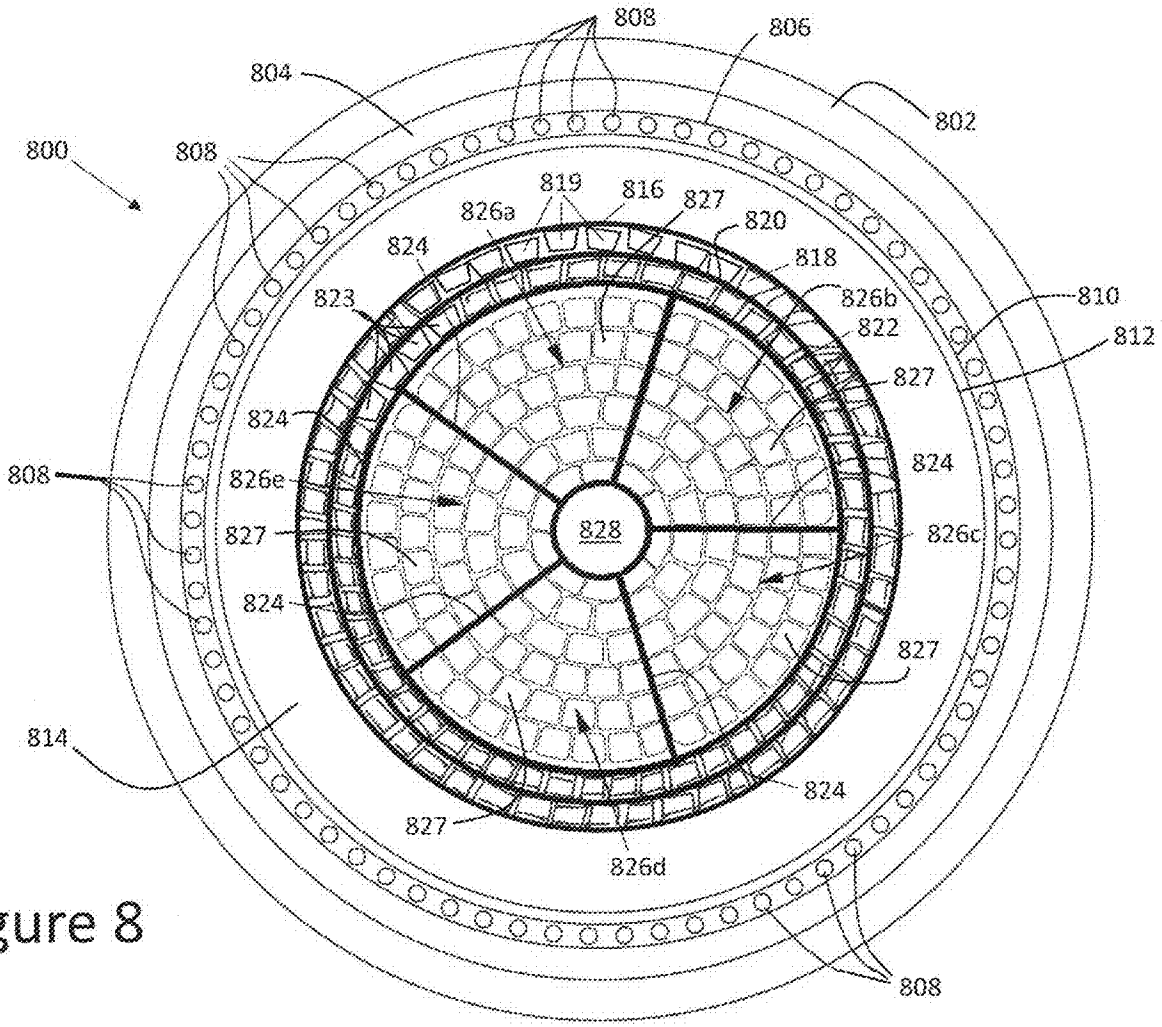
FIG. 8 illustrates a cross-sectional view of Milliken cable 800 having circumferential conducting layers 818, 822.

With reference to FIG. 8, a Milliken-type segmented cable 800 can be implemented in medium or high voltage applications. Cable 800 includes an outer layer 802 of polyethylene, a lead sheath 804, steel tape 806, a layer of reinforcing wire 808, additional steel tape layers 810, 812, a paper layer 814 of carbon and metallized paper, and an insulating layer 816 of semiconducting carbon paper. The insulating layer 816 surrounds a layer 818 of conducting wires 819, which in turn surrounds an additional insulating layer 820, underneath which is an additional layer 822 of conducting wires 823. Another insulating layer 824 underneath the layer 822 of conducting wires 823 surrounds five Milliken style conductor segments 826, and also surrounds and separates the individual segments **826*a*-826*e* from one another. A support member 828 can be disposed at the center of the cable 800. According to another aspect of the present teachings, the support member 828** can be omitted.

The layers of conducting wires 818, 822 are arranged circumferentially around the Milliken conductor segments **826*a*-826*e*. According to one aspect of the present teachings, the combined cross-sectional area of the five Milliken conductor segments 826 can range from about 1000 kcmil to about 4000 kcmil. According to other aspects of the present teachings, the segments 826** can have a combined cross-sectional area of from about 1000 kcmil to about 3500 kcmil, to about 3000 kcmil, to about 2500 kcmil, or to about 2000 kcmil.

The segments 826 and layers 818, 822 can be formed entirely of copper wires, entirely of aluminum wires, or a combination of copper and aluminum wires. The arrangement and distribution of copper and aluminum wires need not be identical between segments 826 or layers 818, 822. The distribution of copper and aluminum wire can vary, ranging from 100 percent copper wires to 100 percent aluminum wires, and any ratio between the two. For example, the conductors 826 or layers 818, 822 can have 95 percent of their cross-sectional area attributable to copper wire and the remainder aluminum wire. According to other aspects of the present teachings, each of the segments 826 or layers 818, 822 can have 90 percent copper wire, 80 percent copper wire, 75 percent copper wire, 60 percent copper wire, or 50 percent copper wire, and the remainder aluminum wire, respectively. According to yet another aspect of the present teachings, each of the segments 826 or layers 818, 822 can have 90 percent aluminum wire, 80 percent aluminum wire, 75 percent aluminum wire, or 60 percent aluminum wire and the remainder copper wire, respectively.

The current carrying conductive wires 819, 823, in layers 818, 822, respectively, can be disposed circumferentially around the segmented Milliken conductors 826. According to one aspect of the present teachings, the wires 819, 823 can be aluminum wires, copper wires, or a combination of both. As just one example of a layer of combined copper and aluminum wires, such a layer can have a single layer of alternating adjacent copper and aluminum wire. According to another aspect of the present teachings, each circumferential layer, such as layers 818, 822, can have a radial thickness of more than one wire, such as by having a two or more strata of wires within a circumferential layer. According to another aspect of the present teachings, more than two additional circumferential layers such as layers 818, 822 can be disposed surrounding a conductor or conductors, such as the Milliken conductors 826 shown in FIG. 8. Like layers 818, 822, additional layers can be separated from one another with insulating layers such as insulating layers 816, 820. In one aspect of the present teachings, five circumferential layers can be added around one or more conductors. In another aspect of the present teachings, ten or more circumferential layers of conducting wires can surround one or more conductors. In the cable shown in FIG. 8, the wires 827 in the Milliken segments 826 and the wires 819, 823 in the circumferential layers 818, 822 are trapezoidal, which can provide benefits to the performance and lifespan of the insulating layers 816, 820. A cable according to the present teachings need not be limited to trapezoidal wires, however, and can instead implement other shapes of wires, such as other polygonal shapes, or rounded shapes such as circular wires.

With further reference to FIG. 8, the wires 819, 823 in the circumferential layers 818, 822 can be enameled copper wires. Such enameled wires 818, 822 can be implemented with the uncoated wires in Milliken segments 826. In such a configuration, stripping enamel from wires would only be required for enameled wires 818, 822, in preparation, for example, for splicing or termination. Such a configuration would retain the benefit of eliminating the need to strip enamel from the wires in the Milliken segments 826.

The surrounding circumferential layers 818, 822, can each have a cross-sectional area of about 250 kcmil or greater. According to another aspect of the present teachings, the surrounding circumferential layers 818, 822, can each have a cross-sectional area of about 1000 kcmil or greater. According to still another aspect of the present teachings, the surrounding circumferential layers 818, 822, can each have a cross-sectional area of about 1500 kcmil or greater. According to a further aspect of the present teachings, the surrounding circumferential layers 818, 822, can each have a cross-sectional area of about 2000 kcmil or greater. Various ranges of cross-sectional areas for circumferential layers such as layers 818, 822, can be implemented according to the present teachings, such as between about 500 kcmil and about 2000 kcmil, or between 1000 kcmil and about 1500 kcmil. Adjacent circumferential layers, such as layers 818, 822, need not have the same thickness or cross-sectional size.

Figure 9:
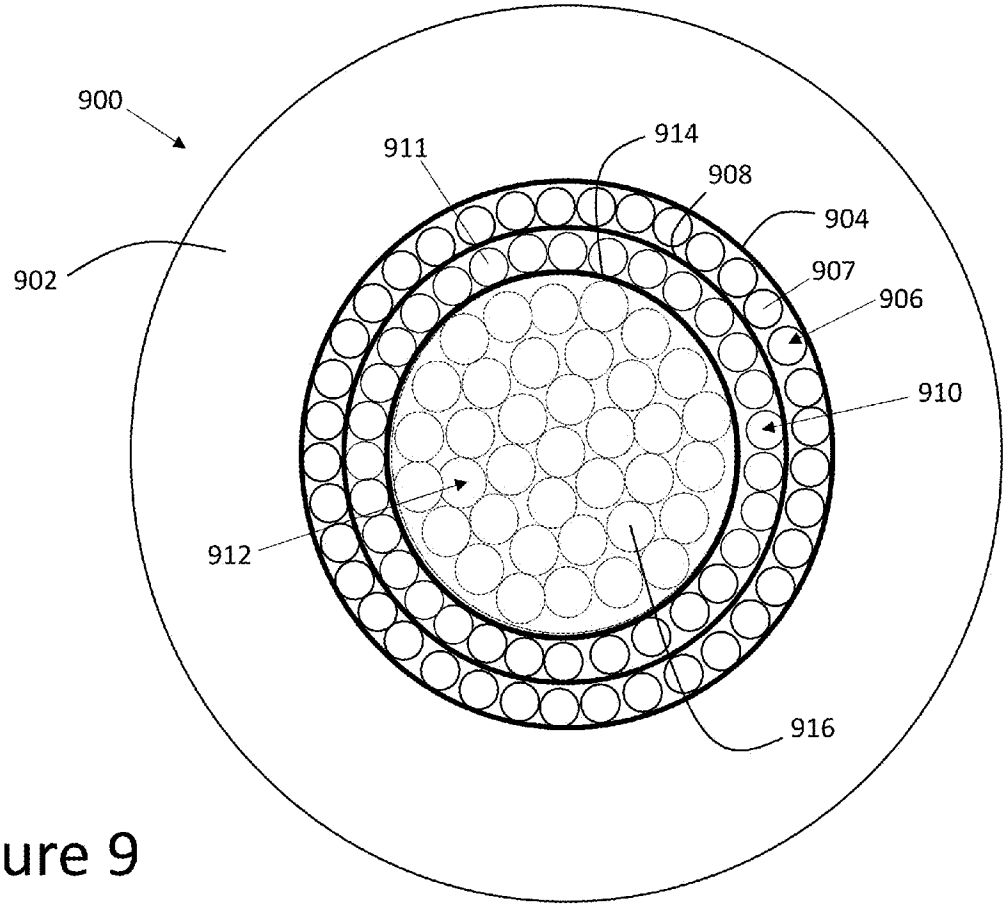
FIG. 9 illustrates a cross-sectional view of cable 900 having circumferential conducting layers 906, 910.

With reference to FIG. 9, a medium or high voltage cable 900 according to the present teachings includes an outer protective layer or layers 902, which can include but is not limited to an outer polypropylene sheath, lead sheath, steel tape, reinforcing steel wires, carbon and metalized paper, and polymer insulators such as cross-linked polyethylene (XLPE). An insulating layer 904, which can be made of material including but not limited to semiconducting carbon paper, surrounds a circumferential layer 906 of wires 907. Another insulating layer 908 separates the circumferential layer 906 from another circumferential layer 910 of wires 911 disposed radially inward relative to circumferential layer 906. The inner circumferential layer 910 is separated from a central conductor 912 by an additional insulating layer 914 that surrounds the central conductor 912.

The central conductor includes wires 916, which can be copper wires, aluminum wires, or a combination of both, such as the conductor shown in FIG. 1 and described herein. According to another aspect of the present teachings, the wires 907, 911 of circumferential layers 906, 910 can be copper wires, aluminum wires, or a combination of both. Circumferential layers 906, 910 or the central conductor 916 that include both copper and aluminum wires can include any integer number of copper or aluminum wires, which sum of copper and aluminum wires result in the total number of wires in the respective layer 906, 910 or central conductor 916. Layers 906, 910 or conductor 916 that combine aluminum and copper conductors can include any number of copper wires ranging from a single copper wire through one minus the total number of wires in the layers 906, 910 or conductor 916, with the remainder of the wires in the layers 906, 910 or conductor 916 being aluminum. In one arrangement according to the present teachings, all of the wires 916 in the central conductor 912 are copper, and all of the wires 907, 911 in the surrounding layers 906, 910 are also copper. In another arrangement, all of the wires 916 in the central conductor 912 are aluminum, and all of the wires 907, 911 in surrounding layers 906, 910 are also aluminum wires. In yet another arrangement, a mixture of copper and aluminum wires are included in the wires 916 in central conductor 912, and all of the wires 907, 911 in surrounding layers 906, 910 are copper wires. In still another arrangement, a mixture of copper and aluminum wires are included in the wires 916 in central conductor 912, and a mixture of copper and aluminum wires are included in the wires 907, 911 in surrounding layers 906, 910, which arrangement can include one or both layers 906, 910 having only one type of wire, whether only copper or only aluminum wires.

According to one aspect of the present teachings, the combined cross-sectional area of the central conductor 912 can range from about 1000 kcmil to about 4000 kcmil. According to other aspects of the present teachings, the conductor 912 can have a combined cross-sectional area of from about 1000 kcmil to about 3500 kcmil, to about 3000 kcmil, to about 2500 kcmil, or to about 2000 kcmil.

The surrounding circumferential layers 906, 910, can each have a cross-sectional area of about 250 kcmil or greater. According to another aspect of the present teachings, the surrounding circumferential layers 906, 910, can each have a cross-sectional area of about 500 kcmil or greater. According to still another aspect of the present teachings, the surrounding circumferential layers 906, 910, can each have a cross-sectional area of about 750 kcmil or greater. According to a further aspect of the present teachings, the surrounding circumferential layers 906, 910, can each have a cross-sectional area of about 1000 kcmil or greater. According to an additional aspect of the present teachings, the surrounding circumferential layers 906, 910, can each have a cross-sectional area of about 1000 kcmil or greater, 1500 kcmil or greater, or 2000 kcmil or greater. Various ranges of cross-sectional areas for circumferential layers such as layers 906, 910 can be implemented according to the present teachings, such as between about 250 kcmil and about 2000 kcmil, or between 500 kcmil and about 1500 kcmil. Adjacent circumferential layers, such as layers 906, 910, need not have the same thickness or cross-sectional size.

According to the present teachings, a multitude of arrangements of core conductors and circumferentially surrounding conductors are possible. Depending on constraints such as cost, ampacity, size, weight, and other considerations, the selection of the size of the core conductor, the number and thickness of surrounding conducting layers, and the constituent wires, whether copper or aluminum or a combination, can be selected to meet such constraints.

In the present disclosure, reference numerals followed by alphabetic indices refer to one of the illustrated elements, while use of the reference numeral without the alphabetic indices refer to one or more of the illustrated elements. For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about A to B is intended to mean from about A to about B, where A and B are the specified values.

The description of various embodiments and the details of those embodiments is illustrative and is not intended to restrict or in any way limit the scope of the claimed invention to those embodiments and details. Additional advantages and modifications will be apparent to those skilled in the art. Therefore, the invention, in its broader aspects, is not limited to the specific details and illustrative examples shown and described. Accordingly, departures may be made from such details without departing from the spirit or scope of the applicant's claimed invention.

The invention claimed is:

1. A medium or high voltage conducting AC cable, comprising:

at least one conductor surrounded by a circumferential insulating layer, the at least one conductor having a cross-sectional area equal to or greater than about 1000 kcmil and less than or equal to about 4000 kcmil; and, at least one layer of conducting wires surrounding the insulating layer, wherein the at least one layer of conducting wires surrounding the insulating layer includes a first and second layer of conducting wires separated by a second circumferential insulating layer, and wherein each of the first and second layer of conducting wires has a cross-sectional area between about 250 kcmil to about 1000 kcmil.

2. The cable of claim 1, wherein the at least one conductor has a cross-sectional area of less than about 3500 kcmil.

3. The cable of claim 1, wherein the at least one conductor has a cross-sectional area of less than about 2500 kcmil.

4. The cable of claim 1, wherein the at least one layer of conducting wires surrounding the insulating layer has a cross-sectional area of at least about 250 kcmil.

5. The cable of claim 1, wherein the at least one conductor includes copper wires having a combined cross-sectional area of less than about 3500 kcmil.

6. The cable of claim 5, wherein the at least one conductor includes at least one aluminum wire.

7. The cable of claim 6, wherein the at least one aluminum wire is uncoated.

8. The cable of claim 1, wherein the at least one conductor includes copper wires having a combined cross-sectional area of less than about 3000 kcmil.

9. The cable of claim 8, wherein the at least one conductor includes at least one aluminum wire.

10. The cable of claim 9, wherein the at least one aluminum wire and copper wires are uncoated.

11. The cable of claim 1, wherein the at least one conductor includes copper wires having a cross-section area of less than about 2500 kcmil.

12. The cable of claim 11, wherein the at least one conductor includes at least one aluminum wire.

13. The cable of claim 12, wherein the at least one aluminum wire and copper wires are uncoated.

14. A medium or high voltage conducting AC cable, comprising:

at least one conductor surrounded by a circumferential insulating layer, the at least one conductor having a cross-sectional area equal to or greater than about 1000 kcmil and less than or equal to about 4000 kcmil; and, at least one layer of conducting wires surrounding the insulating layer, wherein the at least one layer of conducting wires surrounding the insulating layer includes from 5 to 10 circumferential layers of conducting wires separated from one another by insulating layers.

15. The cable of claim 1, wherein the plurality of conducting wires includes at least one unshielded copper wire.

16. The cable of claim 15, wherein the plurality of conducting wires includes at least one unshielded aluminum wire.

17. The cable of claim 1, wherein the at least one conductor and plurality of conducting wires are configured to conduct current at medium or high voltage.

18. The cable of claim 1, wherein the conducting wires include enameled copper wires.

19. A medium or high voltage AC conducting cable, comprising:

at least one conductor surrounded by a circumferential insulating layer, the at least one conductor including copper wires having a combined cross-sectional area less than or equal to about 4000 kcmil; and, at least one layer of conducting wires surrounding the insulating layer, wherein the at least one layer of conducting wires surrounding the insulating layer includes a first and second layer of conducting wires separated by a second circumferential insulating layer, and wherein each of the first and second layer of conducting wires has a cross-sectional area between about 250 kcmil to about 1000 kcmil.

* * * * *